United States Patent [19]

Mochinaga et al.

[11] Patent Number: 4,615,750

[45] Date of Patent: Oct. 7, 1986

[54] PROCESS FOR PRODUCING A GRAIN-ORIENTED ELECTRICAL STEEL SHEET

[75] Inventors: Kishio Mochinaga; Kohichi Fujiwara; Kazutaka Higashine, all of Himeji; Hisashi Kobayashi, Kawasaki, all of Japan

[73] Assignee: Nippon Steel Corporation, Tokyo, Japan

[21] Appl. No.: 609,201

[22] Filed: May 11, 1984

[30] Foreign Application Priority Data

May 12, 1983 [JP] Japan ..... 58-83340

[51] Int. Cl.[4] ..... H01F 1/04

[52] U.S. Cl. ..... 148/111; 148/112; 148/308

[58] Field of Search ..... 148/111, 112

[56] References Cited

U.S. PATENT DOCUMENTS

| | | | |
|---|---|---|---|
| 3,986,902 | 10/1976 | Regitz | 148/110 |
| 4,006,044 | 2/1977 | Oya et al. | 148/111 |
| 4,212,689 | 7/1980 | Shimizu et al. | 148/111 |
| 4,244,757 | 1/1981 | Malagari et al. | 148/111 |
| 4,437,909 | 3/1984 | Mori et al. | 148/111 |

FOREIGN PATENT DOCUMENTS

| | | |
|---|---|---|
| 48-69720 | 9/1973 | Japan . |
| 58-42727 | 3/1983 | Japan . |

OTHER PUBLICATIONS

Chen, "Recent Developments in Soft Magnetic Materials," J. of Magnetism and Magnetic Materials, 7 (1978), pp. 308-311.

Stroble, "Precipitate Morphology in MnS-AlN-Inhibited High Permeability Grain Oriented Silicon Steel," IEEE Trans. on Magnetics, vol. MAG-12, No. 6, Nov. 1976, pp. 861-862.

*Primary Examiner*—John P. Sheehan

*Attorney, Agent, or Firm*—Kenyon & Kenyon

[57] ABSTRACT

The present invention relates to a process for producing a grain-oriented electrical steel sheet by means of the so-called double-rolling process, using Mn, S, and Cu as the precipitation dispersion phases for suppressing the growth of primary-recrystallized crystal grains.

A new concept according to the present invention is to suppress the growth of primary crystals by means of an element segregated in the grain boundaries of primary-recrystallized crystals.

The present invention is characterized in that the silicon steel starting material contains T.[N] in an amount which satisfies the following formulas (1) and (2):

$$T.[N] \geqq \{[\text{sol Al}\%] \times (14/27) + 0.0020\}(\%) \quad (1)$$

$$T.[N] \leqq \{[\text{sol Al}\%] \times (14/27) + 0.0060\}(\%) \quad (2).$$

3 Claims, 4 Drawing Figures

PROCESS FOR PRODUCING A GRAIN-ORIENTED ELECTRICAL STEEL SHEET

BACKGROUND OF THE INVENTION

1. Field of the Invention

The present invention relates to a process for producing a grain-oriented electrical steel sheet, the crystal grains thereof having a {110}<001> orientation, which is easily magnetizable in the rolling direction.

The grain-oriented electrical steel sheet is used as soft magnetic material for a core of a transformer and other electric machineries and apparatuses. Because of the recent shortage in electric power and the need to conserve energy resources, demands for grain-oriented electrical steel sheets having a low watt loss have been increasing.

2. Description of the Prior Art

Japanese Unexamined Patent Publication No. 48-69720 discloses a process for producing a grain-oriented electrical steel sheet by utilizing as the precipitation dispersion phases mainly MnS and proposes, in order to disperse MnS uniformly and at a high distribution density and hence to improve the magnetic properties of the final product, that, during the hot-rolling stage, holding be carried out at a temperature not greater than 1200° C. and not less than 950° C. for a period of from 30 seconds to 200 seconds.

The present inventors made repeated studies in an attempt to improve the magnetic properties of a grain-oriented electrical steel sheet, with MnS as the precipitation dispersion phases, and proposed, in Japanese Unexamined Patent Publication No. 58-42727, that $Cu_2S$ be used, in addition to MnS, as the precipitation dispersion phases to strengthen the precipitation dispersion. In this case, the secondary cold-rolling provides a high ratio of from 50% to 80%, thereby enhancing the magnetic flux density and improving the watt loss due to refinement of the macro-grains of the final product. When an attempt is made to further decrease the watt loss, the magnetic flux density must be stabilized and the macro-grains of the final product must be refined. In order to attain this, the contents of Cu, Mn, and S must be increased, and the final cold-rolling must be carried out at a higher ratio so as to further strengthen the precipitation dispersion. However, when the Cu content is increased, cracks form in the slabs during heating due to hot-embrittlement, or the slabs may be ruptured during hot-rolling, with the result that the recovery and the operation efficiency are seriously lessened. On the other hand, when the Mn and S contents are increased, the solution temperature is enhanced, and, hence, the slabs must be thoroughly heated at a high temperature, with the result that the same problems as in the case of increasing the Cu content result.

Methods for producing a grain-oriented electrical steel sheet by utilizing Al and N as precipitation-dispersion phases are well known. However, if the precipitation-dispersion phases comprised of AlN are utilized for the so-called two-stage cold-rolling process including two cold-rollings and two annealings, to which the present invention belongs, the diameter of the macro-grains is large in the final product, and, hence, the watt loss is deteriorated.

As is well known, suppression of the growth of primary crystal grains is important for stabilizing secondary recrystallization so as to generate crystal grains having a {110}<001> orientation, especially when the sheet thickness of the product is thin.

SUMMARY OF THE INVENTION

The present inventors arrived at the conclusion that strengthening the precipitation dispersion only the growth of primary- recrystallized crystal grains can be suppressed only to a limited extent. The present inventors then had a new concept of suppressing the growth of primary crystals by means of an element segregated in the grain boundaries of primary-recrystallized crystals, which element is hereinafter referred to as a grain-boundary segregation element. The present inventors extensively investigated grain-boundary segregation elements and discovered that [N] is the most appropriate grain-boundary segregation element. [N] has the effect of prominent suppression of the primary-crystallized grains when it is segregated in the grain boundaries, and, subsequently, [N] is easily removed, i.e., denitrification can be easily carried out, in the $H_2$ atmosphere at a high temperature during final annealing. In addition, [N] is less expensive than other grain-boundary segregation elements, such as Sb, As, Sn, B, Pb, and the like, and is not detrimental to the formation of a primary film during decarburizing and, final annealing as are the other grain-boundary segregation elements.

It is therefore, an object of the present invention to provide an improved process for producing, by the so-called two-stage cold- rolling process, a grain-oriented electrical steel sheet having a low watt loss.

In accordance with the present invention, there is provided a method for producing a grain-oriented electrical steel sheet, wherein the silicon steel starting material contains, as basic components, 0.085% or less of C, from 2.0% to 4.0% of Si, from 0.030% to 0.090% of Mn, from 0.010% to 0.060% of S, from 0.02% to 0.2% of Cu, and 0.0050% or less of sol.Al and satisfies, if necessary, at least one of (a) and (b): (a) a specified P content of 0.010% or less and (b) an Sn alloying content of 0.1% or less. The silicon steel starting material is hot-rolled, is cold-rolled and annealed twice so as to form a sheet having a thickness of from 0.35 mm to 0.15 mm, characterized in that the silicon steel starting material contains T.[N] in an amount which satisfies the following formulas (1) and (2):

$$T.[N] \geqq \{[\text{sol Al } \%] \times 14/27 + 0.0020\}(\%) \quad (1)$$

$$T.[N] \leqq \{[\text{sol Al } \%] \times 14/27 + 0.0060\}(\%) \quad (2)$$

The term T.[N] herein means total nitrogen content, that is, nitrogen in molten steel.

The present invention is now described in detail.

[N] is interstitial when it is a solute atom of iron. The solid-solution quantity of [N] is very small in the iron when it has a ferrite phase, that is, [N] is interstitially solid-dissolved in the body-centered cubic lattice or iron at a very small amount. Especially in the production of a grain-oriented electrical steel sheet, when decarburization annealing is carried out, the austenite phase (face-centered cubic lattice), in which the solid-solution amount of [N] is large, cannot remain in the silicon steel. This steel is then finally annealed.

Based on the considerations of the solid solution amount of [N], the present inventors presumed that [N] can be present in silicon steel, prior to final annealing, in the form of either: a compound such as AlN, a nitride such as silicon nitride or iron nitride (formed due to the concentration of [N] in the grain boundaries), or free [N].

As was previously mentioned, according to the studies of the present inventors, the concentrated [N] in the grain boundaries is effective for suppressing the growth of primary crystal grains during final annealing.

In order to verify such an effect, the following experiments were carried out.

Silicon steel starting materials having the composition as given in Table 1 were melted, continuously casted to form slabs, hot-rolled in a conventional manner, and subsequently cold-rolled twice and annealed twice. The ratio of the secondary (last) cold-rolling was 65%.

The magnetic properties of the products are shown in Table 2.

TABLE 1

| COMPOSITION OF MOLTEN STEEL (wt. %) | | | | | | | | |
|---|---|---|---|---|---|---|---|---|
| | Elements | | | | | | | |
| Heat No. | C | Si | Mn | P | S | Sol. Al | T. [N] | Cu |
| a | 0.043 | 3.15 | 0.060 | 0.018 | 0.021 | 0.0025 | 0.0025 | 0.17 |
| b | 0.042 | 3.14 | 0.059 | 0.017 | 0.020 | 0.0020 | 0.0050 | 0.18 |

TABLE 2

| | MAGNETIC PROPERTIES (Sheet Thickness of 0.30 mm) | | | | | | |
|---|---|---|---|---|---|---|---|
| Heat | T | | M | | B | | Diameter of Macro grains of Product |
| No. | $W_{17/50}$ | $B_{10}$ | $W_{17/50}$ | $B_{10}$ | $W_{17/50}$ | $B_{10}$ | (ASTM No.) |
| a | $1.17^{w/kg}$ | $1.87^{T}$ | $1.18^{w/kg}$ | $1.86^{T}$ | $1.18^{W/kg}$ | $1.86^{T}$ | 7.6 |
| b | 1.15 | 1.87 | 1.17 | 1.87 | 1.16 | 1.87 | 8.0 |

In heat "b" in Table 2, the T.[N] content was more than that for fixing [N] as AlN. In heat "a", the T.[N] content was less than that for fixing [N] as AlN.

The experiments are further explained with reference to FIGS. 1 and 2.

The symbol ◎ indicates $W_{17/50} \leqq 1.20$ W/kg, the symbol o indicates $W_{17/50} \leqq 1.22$ W/kg, the symbol Δ indicates $W_{17/50} \leqq 1.24$ W/kg, and the symbol x indicates $W_{17/50} > 1.24$ W/kg.

Figure 4:
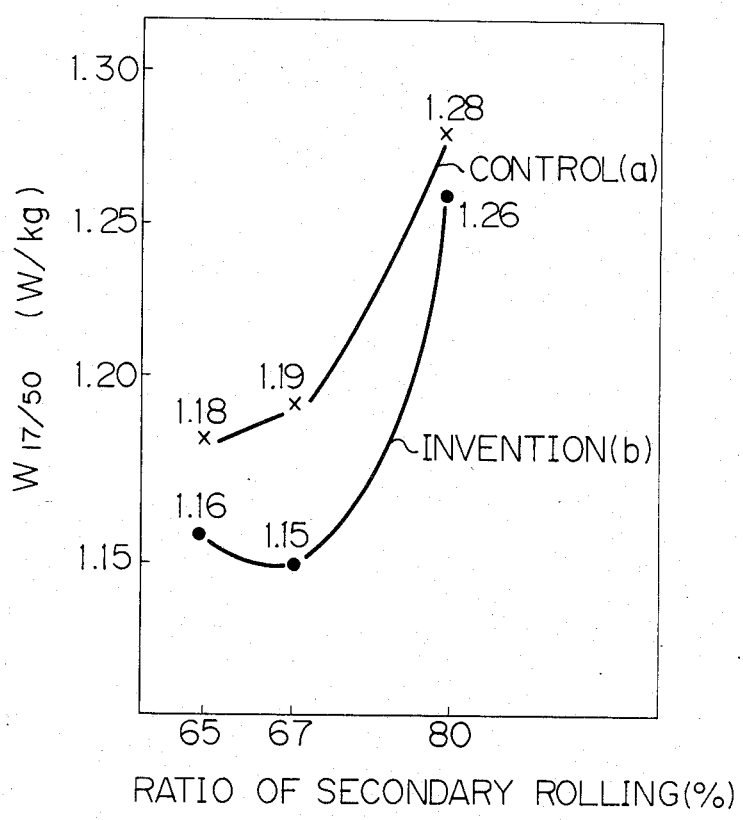

FIG. 4 is a graph showing the relationship between the watt loss and the ratio of secondary cold-rolling.

Figure 1:
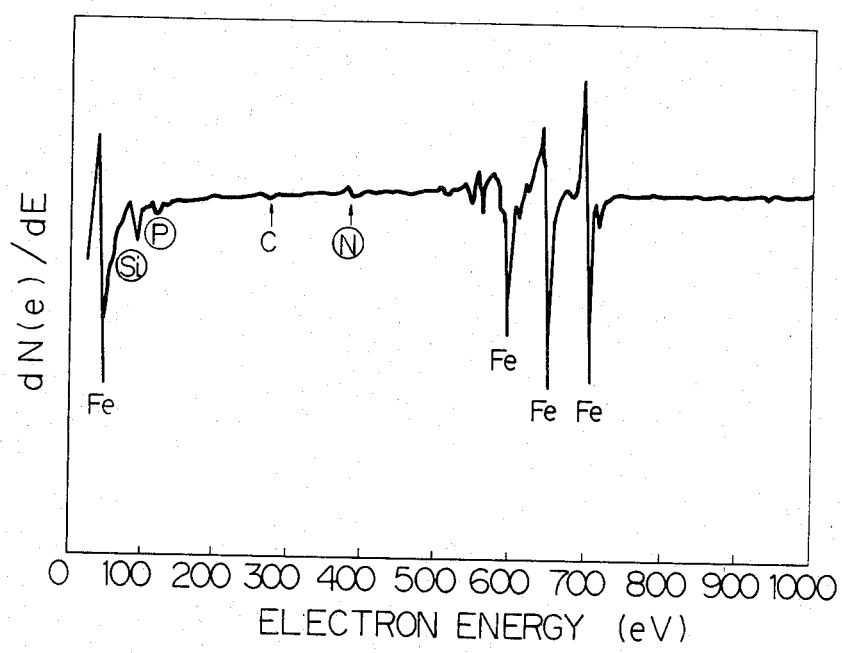
FIGS. 1 and 2 are AES (Auger Electron Spectroscopy) spectrographic charts of the fractured surface of the grain boundaries of steel which was decarburization-annealed. The symbol dN(e)/dE in FIGS. 1 and 2 indicates the electron density of every energy.

Referring to FIG. 1, not only Si, P, and C but also [N] was detected on the fractured surface of the grain boundaries of heat "b", in which the T.[N] content was more than that at which [N] is entirely fixed as AlN.

Figure 2:
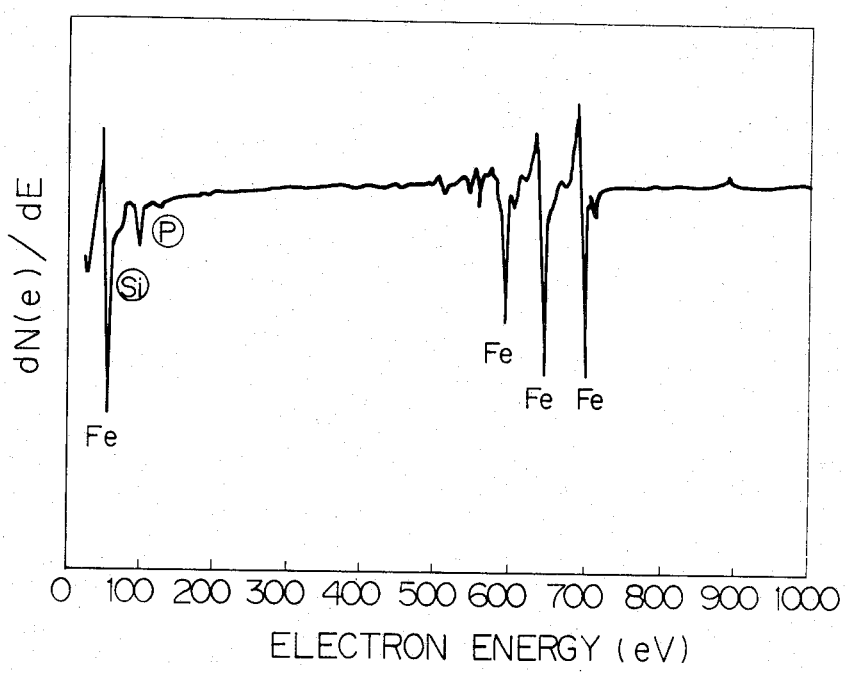

Referring to FIG. 2, [N] was not detected on the fractured surface of the grain boundaries of heat "a", in which the T.[N] content was low.

Figure 3:
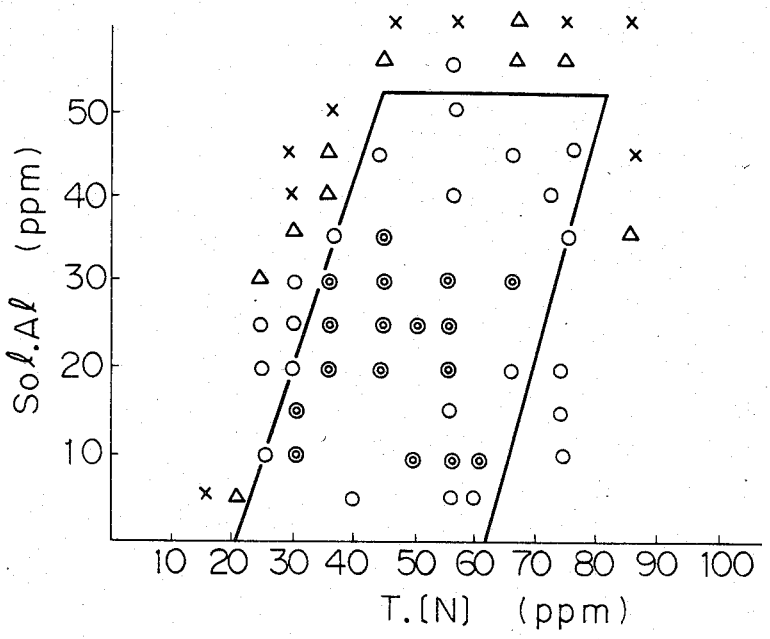
FIG. 3 is a graph showing the relationships between the sol.Al content, the T.[N] content, and the watt loss.

In order to determine the appropriate excess amount of T.[N] higher than the T.[N] content at which [N] is entirely fixed as AlN, a number of tests were carried out. In these tests, the compositions of the silicon steel starting materials were fundamentally the same as those of heat "b", and the process conditions were the same as those described with reference to heats "a" and "b". The results of the tests are shown in FIG. 3. It was discovered, as is shown in FIG. 3, that the T.[N] content is advisably from $$\{[\text{sol Al }\%]\times 14/27+0.0020\}(\%) \text{ to } \{[\text{sol Al }\%]\times 14/27+0.0060\}(\%).$$

Several of the hot-rolled strips produced by using heats "a" and "b" were subjected to cold-rolling twice and annealing twice, while varying the ratio of secondary cold-rolling, so as to investigate the relationships between the ratio of secondary cold-rolling and the watt loss. The results are shown in FIG. 4. As is apparent from FIG. 4, in heat "b", i.e., the silicon steel starting material, according to the present invention, secondary recrystallization was stable because of the effects of [N], and the ratio of secondary cold-rolling to obtain the lowest watt loss was as high as 67%.

The constitutions of the present invention are now explained in detail.

The C content of the silicon steel starting material is 0.085% or less. If the C content is more than 0.085%, the magnetic properties are deteriorated, and the time required for decarburization at a stage later than the melting stage is long.

Si is an element which is effective for decreasing the watt loss. If the Si content is less than 2.0%, the effect of Si is not appreciable. On the other hand, if the Si content is more than 4.0%, cracks are liable to form during cold-rolling, making cold-rolling difficult.

Mn, S, and Cu form the precipitation dispersion phases which play an important role in the growth of secondary-recrystallized grains. The Mn content is from 0.030% to 0.090%, the S content is from 0.010% to 0.060%, and the Cu content is from 0.02% to 0.2%.

If the Mn content is less than 0.030%, the S content is less than 0.010%, and the Cu content is less than 0.02%, the absolute amounts of MnS and Cu2S are insufficient for the growth of secondary-recrystallized grains. On the other hand, if the Mn content is more than 0.090% and the S content is more than 0.060%, Mn and S cannot be solid-dissolved at a normal heating temperature of a slab, e.g., from 1200° C. to 1400° C., with the result that appropriate precipitation-dispersion phases for the satisfactory development of secondary recrystallization are not present in the silicon steel strip. If the Cu content is more than 0.2%, the operation properties, such as the properties of pickling and decarburization, of a silicon steel strip are impaired.

The sol.Al content is 0.0050% or less. If the sol.Al content is more than 0.0050%, the diameter of the macro-grains of the final product is large, and, hence, the magnetic properties are impaired. The T.[N] content is from $$\{[\text{sol Al }\%]\times 14/27+0.0020\}(\%) \text{ to } \{[\text{sol Al }\%]\times 14/27+0.0060\}(\%).$$

If the T.[N] content is less than $\{[\text{sol.Al }\%]\times 14/27+0.0020\}\%$, the excessive amount of [N] is too small to attain boundary segregation, with the result that the magnetic properties cannot be ensured. On the other hand, if the T.[N] content is more than $\{[\text{sol.Al }\%]\times 14/27+0.0060\}\%$, nitrogen cannot be satisfactorily removed from a steel strip during final annealing, with the result that magnetic-property failures occur.

The silicon-steel starting material of the present invention is produced by a conventional melting method. The molten steel is tapped from a converter on the like and is secondarily refined by a conventional method, such as RH degassing process. The sol.Al content is determined at tapping, as is well known. The T.[N] content is controlled in the secondary refining stage by blowing nitrogen gas into the molten steel or denitrifying the molten steel. It is advisable to set the target value of the sol.Al content to 0.0020% and to control the sol.Al content so that it does not exceed 0.0050% since the T.[N] content can be easily controlled within the range of the present invention.

The molten steel, the composition of which is controlled as described above, is cast by a conventional ingot-making method or by a continuous-casting method to form a slab.

A slab is usually heated to a temperature of from 1200° C. to 1400° C. prior to hot-rolling and is hot-rolled into a strip by a continuous hot-rolling mill including a plurality of stands.

The preferred conditions of hot-rolling are now described. The temperature of a strip at the inlet side of finishing hot-rolling stands is preferably from 1100° C. to 1250° C. This temperature is hereinafter referred to as the finishing inlet temperature. If the finishing inlet temperature is more than 1250° C., the precipitation amount of the sulfides tends to be small. In this case, secondary-recrystallization is unstable. In addition, abnormally coarse grains which are formed during slab heating remain even in the final product, with the result that secondary-recrystallized grains cannot be stably formed. If the finishing inlet temperature is less than 1100° C., the precipitated sulfides tend to coagulate. In this case, the inhibitor effects of the precipitated dispersion phases are drastically lessened, and secondary recrystallization is unstable.

The temperature of a strip at the outlet side of the finishing hot-rolling stands (hereinafter referred to as the finishing outlet temperature) is preferably from 900° C. to 1050° C., more preferably from 950° C. to 1000° C., at the top of the strip and from 950° C. to 1150° C., more preferably from 1000° C. to 1100° C., at the middle and the bottom of the strip. If the finishing outlet temperature of the top of the strip is more than 1050° C., the precipitation of sulfides tends to be insufficient for stabilizing secondary recrystallization. On the other hand, if the finishing outlet temperature of the top of the strip is less than 950° C., the $Cu_2S$-based precipitation dispersion phases tend to coagulate. If the finishing outlet temperature of the middle and the bottom of the strip is less than 950° C., the $Cu_2S$-based precipitation dispersion phases also tend to coagulate. In this case, the inhibitor effects of the precipitation dispersion phases are drastically lessened, with the result that the macrograins of the final product coarsen and fine grains, which are referred to as streaks, are formed in the final product. On the other hand, if the finishing outlet temperature of the middle and the bottom of the strip is more than 1150° C., the precipitation amount of $Cu_2S$ tends to be small. In this case, the levels of the magnetic properties are decreased, and magnetic abnormalities occur. The finishing outlet temperature of the strip is preferably lower at the top and higher at the middle and the bottom. The finishing outlet temperature described above is provided by controlling the amount of water which is sprayed onto a strip being finishing hot-rolled.

Next, the cold-rolling stage is described. The cold-rolling stage is carried out by a process which is usually referred to as a double-stage process. In this process, primary cold-rolling, intermediate annealing, secondary cold-rolling, decarburizing annealing, and final annealing are included. The ratio of primary cold-rolling is optional but is usually from 40% to 90%. The ratio of secondary cold-rolling is preferably from 50% to 80%.

The sheet thickness of the final product is from 0.35 mm to 0.15 mm according to the present invention. If the sheet thickness is less than 0.15 mm, secondary recrystallization is unstable and, therefore, improvement of the magnetic properties is difficult. The maximum sheet thickness of the final product of 0.35 mm corresponds to the thickest commercially available products.

According to the present invention, C, Mn, S, Cu, sol.Al, T.[N] (in the amount described above), Fe, and unavoidable impurities constitute 100% of the inventive composition.

According to a preferred composition of the silicon steel starting material, the material additionally contains a minor amount of Sn. Sn in a minor amount is effective for further refining the crystal grains size of the final product and, hence, further improving the watt loss. A preferred Sn content is 0.10% or less.

When the content of P, which is one of the unavoidable impurities, is drastically decreased, the number of P-based inclusions is decreased, thereby contributing to optimum precipitation and dispersion of the $Cu_2S$- and MnS-based phases. In this case, the magnetic flux density is increased and the watt loss is further improved. A preferred content is 0.01% or less.

The present invention is now explained by way of an Example.

EXAMPLE

Molten steels, the composition of which was adjusted to that given in Table 3, were continuously cast to form 250 mm-thick slabs.

TABLE 3

| Heat No. | COMPOSITION OF MOLTEN STEEL (%) | | | | | | | | | Remarks |
|---|---|---|---|---|---|---|---|---|---|---|
| | C | Si | Mn | P | S | Sol. Al | Cu | T. [N] | Sn* | |
| 1 | 0.043 | 3.13 | 0.058 | 0.017 | 0.024 | 0.0025 | 0.16 | 0.0023 | 0.003 | |
| 2 | 0.042 | 3.15 | 0.061 | 0.018 | 0.025 | 0.0024 | 0.17 | 0.0028 | 0.004 | |
| 3 | 0.044 | 3.16 | 0.059 | 0.016 | 0.026 | 0.0028 | 0.18 | 0.0044 | 0.005 | Invention |
| 4 | 0.042 | 3.14 | 0.060 | 0.018 | 0.027 | 0.0020 | 0.17 | 0.0048 | 0.006 | |
| 5 | 0.043 | 3.12 | 0.058 | 0.008 | 0.025 | 0.0023 | 0.17 | 0.0046 | 0.003 | |
| 6 | 0.045 | 3.16 | 0.059 | 0.018 | 0.026 | 0.0030 | 0.18 | 0.0050 | 0.080 | |

*Sn ≦ 0.006% is a tramp element in molten steel.

The slabs were heated to 1200° C.~1400° C. and then were hot-rolled and coiled. The finishing outlet temperature of the top of the strips was from 900° C. to 1050° C., and the finishing outlet temperature of the middle and the bottom of the strips was from 950° C. to 1150° C. The thickness of the hot-rolled strips was 2.50 mm. The hot-rolled strips were cold-rolled (primary cold-rolling), intermediate-annealed at 850° C. for 3 minutes, and again cold-rolled (secondary cold-rolling). The ratios of secondary cold-rolling were 65% and 67% for each heat. The thickness of the cold-rolled strips was 0.30 mm. The cold-rolled strips were decarburized to a C content of 0.0030% or less by heating them to a temperature of 840° C. for 3 minutes in a wet hydrogen and nitrogen atmosphere. The decarburized cold-rolled strips were finally annealed at a temperature of 1170° C. for 20 hours in hydrogen gas. The magnetic properties of the final products are shown in Table 4.

TABLE 4

| Heat No. | Ratio of Secondary Rolling | MAGNETIC PROPERTIES $W_{17/50}$ (W/kg) $\bar{x}$ | Range | $B_{10}$ (T) $\bar{x}$ | Range | Diameter of Macro-grains of Product $\bar{x}$ | Range |
|---|---|---|---|---|---|---|---|
| 1,2 | 65% | 1.201 | 1.40~1.25 | 1.860 | 1.82~1.88 | 7.60 | 7.0~8.5 |
| | 67% | 1.210 | 1.15~1.28 | 1.850 | 1.80~1.87 | 7.70 | 7.0~9.0 |
| 3,4 | 65% | 1.181 | 1.13~1.22 | 1.865 | 1.84~1.88 | 7.80 | 7.0~8.5 |
| | 67% | 1.170 | 1.12~1.20 | 1.865 | 1.84~1.88 | 7.85 | 7.0~8.7 |
| 5 | 65% | 1.171 | 1.12~1.21 | 1.862 | 1.84~1.88 | 7.9 | 7.2~8.5 |
| 6 | 65% | 1.170 | 1.13~1.20 | 1.865 | 1.85~1.88 | 8.0 | 7.2~8.5 |

As is apparent from the foregoing descriptions, the method according to the present invention is characterized by using MnS and $Cu_2S$ as precipitation dispersion phases, specifying the T.[N] content, and carrying out the double cold-rolling process. The magnetic properties, especially the watt loss, are improved by the method for producing a grain-oriented electrical steel sheet according to the present invention.

We claim:

1. A process for producing a grain-oriented electrical steel sheet, wherein the silicon steel starting material consists essentially of, as basic components, 0.085% or less of C, from 2.0% to 4.0% of Si, from 0.030% to 0.090% of Mn, from 0.010% to 0.060% of S, from 0.02% to 0.2% of Cu, and 0.0050% or less of sol.Al, and said silicon steel starting material is hot-rolled, cold-rolled twice so as to form a sheet having a thickness of from 0.35 mm to 0.15 mm, decarburization-annealed and final annealed said silicon steel starting material contain T. [N] in an amount which satisfies the following the formulas (1) and (2):

$$T.[N] \geqq \{[\text{sol Al } \%] \times 14/27 + 0.0020\}(\%) \quad (1)$$

$$T.[N] \leqq \{[\text{sol Al } \%] \times 14/27 + 0.0060\}(\%) \quad (2)$$

thereby segregating excess nitrogen at the grain-boundaries in the decarburization step.

2. A process according to claim 1, wherein said silicon steel starting material satisfies at least one of (a) and (b): (a) a specified P content of 0.010% or less and (b) an Sn alloying content of 0.1% or less.

3. A process for producing a grain-oriented electrical steel sheet, wherein the silicon steel starting material contains, as basic components, 0.085% or less of C, from 2.0% to 4.0% of Si, from 0.030% to 0.090% of Mn, from 0.010% to 0.060% of S, from 0.02% to 0.2% of Cu, and 0.0050% or less of sol.Al, and said silicon steel starting material is hot-rolled, cold-rolled twice so as to form a sheet having a thickness of from 0.35 mm to 0.15 mm, decarburization-annealed and final annealed said silicon steel starting material contains T. [n] in an amount which satisfies the following formulas (1) and (2):

$$T.[N] \geqq \{[\text{sol Al } \%] \times 14/27 + 0.0020\}(\%) \quad (1)$$

$$T.[N] \leqq \{[\text{sol Al } \%] \times 14/27 + 0.0060\}(\%) \quad (2)$$

thereby segregating excess nitrogen at the grain-boundaries in the decarburization step, and wherein the silicon steel starting material is hot-rolled into a strip by a continuous hot-rolling mill including a plurality of stands, the temperature of the strip at the finishing inlet side of the finishing hot-rolling stands being from 1100° C. to 1250° C. and the temperature of the top of the strip at the outlet side of the finishing hot-rolling stands being from 900° C. to 1050° C. that at the middle and bottom of the strip being and from 950° C. to 1150° C.

* * * * *

UNITED STATES PATENT AND TRADEMARK OFFICE

CERTIFICATE OF CORRECTION

PATENT NO. : 4,615,750

DATED : October 7, 1986

INVENTOR(S) : K. Michinaga, et al.

It is certified that error appears in the above-identified patent and that said Letters Patent is hereby corrected as shown below:

Column 2, line 6, before "strengthening" insert the word --by-- and after "only" insert a comma.

Column 2, line 25, omit the comma after "and".

Column 5, line 3, change "on" to --or--.

Column 7, line 45, change "contain" to --contains--.

Column 8, line 49, omit "and" between "being" and "from".

Signed and Sealed this

Twenty-first Day of April, 1987

*Attest:*

DONALD J. QUIGG

*Attesting Officer*

*Commissioner of Patents and Trademarks*